US007105786B2

(12) United States Patent
Kanzaki et al.

(10) Patent No.: US 7,105,786 B2
(45) **Date of Patent: *Sep. 12, 2006**

(54) HIGH FREQUENCY HEATING APPARATUS

(75) Inventors: Kouji Kanzaki, Yamatokoriyama (JP); Yuji Hayakawa, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/459,898

(22) Filed: Jun. 12, 2003

(65) Prior Publication Data

US 2003/0230569 A1 Dec. 18, 2003

(30) Foreign Application Priority Data

Jun. 14, 2002 (JP) ..... P. 2002-173752

(51) Int. Cl.
*H05B 6/68* (2006.01)
*H05B 6/80* (2006.01)
*F24H 1/00* (2006.01)

(52) U.S. Cl. ..... 219/682; 219/401; 219/710; 99/325; 99/451

(58) Field of Classification Search ..... 219/682, 219/685, 680, 710, 712, 711, 702, 716, 718, 219/401; 99/325, 451
See application file for complete search history.

(56) References Cited

U.S. PATENT DOCUMENTS 4,477,705 A 10/1984 Danley et al.
4,506,127 A * 3/1985 Satoh ..... 219/710
5,350,901 A * 9/1994 Iguchi et al. ..... 219/630
5,525,782 A * 6/1996 Yoneno et al. ..... 219/682
5,767,487 A * 6/1998 Tippmann ..... 219/682
5,797,312 A 8/1998 Brant
6,008,482 A * 12/1999 Takahashi et al. ..... 219/687
6,802,708 B1 * 10/2004 Kanzaki et al. ..... 219/682
2004/0053187 A1 * 3/2004 Kanzaki et al. ..... 432/219

FOREIGN PATENT DOCUMENTS

| | | | | |
|---|---|---|---|---|
| CN | 1188534 | | 7/1998 | |
| EP | 0 856 704 A1 | | 8/1998 | |
| EP | 1 148 765 A2 | | 10/2001 | |
| JP | 54-115448 | | 9/1979 | |
| JP | 54-115449 | * | 9/1979 | ..... 219/682 |
| JP | 04-187914 | | 10/1992 | |
| JP | 6-249445 | | 9/1994 | |
| JP | 2000-184964 | * | 7/2000 | |
| WO | WO 95/32603 | | 11/1995 | |

* cited by examiner

*Primary Examiner*—Philip H. Leung
(74) *Attorney, Agent, or Firm*—Pearne & Gordon LLP

(57) ABSTRACT

A high frequency heating apparatus with steam generation function for supplying at least any one of high frequency and steam to a heating chamber 11 for accommodating an object to be heated and heat-treating the object to be heated, the apparatus has a high frequency generating part 13, a steam generating part 15 for generating steam inside the heating chamber 11, a temperature detecting part 20 for detecting temperature of the steam generating part, and a control part 501 for controlling a heater, wherein the steam generating part is controlled to heat based on temperature information of the temperature detecting part.

12 Claims, 11 Drawing Sheets

HIGH FREQUENCY HEATING APPARATUS

BACKGROUND OF THE INVENTION

The present invention relates to a high frequency heating apparatus with steam generation function in which high frequency heating and steam heating are combined to heat-treat an object to be heated.

Traditionally, in this type of high frequency heating apparatus, there are a microwave oven with a high frequency generator for heating, and a combination oven that a convection heater for generating heated air is added in this microwave oven. In addition, a steamer that steam is introduced into a heating chamber and a steam convection oven that a convection heater is added in a steamer are also used as cooking appliances.

When food is cooked by the cooking appliance, the cooking appliance is controlled so as to cook the food in the best condition. More specifically, the cooking of combining high frequency heating with hot air heating can be controlled by the combination oven, and the cooking of combining steam heating with hot air heating can be controlled by the steam convection oven. However, in the cooking of combining high frequency heating with steam heating, efforts are needed that food to be cooked is transferred between different cooking appliances in each of heat treatment. In order to solve the inconvenience, there is a cooking appliance that realizes high frequency heating, steam heating, and electric heating by a single appliance. This cooking appliance is disclosed in JP-A-54-115448.

However, according to the configuration of the publication, a vaporizing chamber for generating heated steam is embedded under a heating chamber, and water is supplied from a water storage tank at a fixed water level all the time. Therefore, it is difficult to clean the periphery of the heating chamber everyday. A problem arises particularly in the vaporizing chamber that calcium and magnesium in water are concentrated to precipitate and fix onto the bottom of the vaporizing chamber or the inside of pipes to reduce an amount of steam generated in the course of generating steam, and consequently the chamber is turned to a dirty environment where mold is easily propagated.

In addition, as a system for introducing steam into the heating chamber, it can be considered that steam is generated by a heating unit such as a boiler disposed outside the heating chamber and the steam generated here is supplied to the heating chamber. However, problems arise that mold is contaminated and propagated in a pipe for introducing steam, the pipe for introducing steam is damaged by freezing, and foreign substances such as rust are mixed. Furthermore, the heating unit is often difficult to be disassembled and cleaned. Therefore, in the cooking appliances that particularly require the attention to the hygiene of food to be treated, the system for introducing steam from outside is hard to adopt.

SUMMARY OF THE INVENTION

The invention has been made in consideration of the circumstances. An object is to provide a high frequency heating apparatus with steam generation function in which a steam generating part is easy to clean and can be kept hygienically all the time, temperatures of the steam generating part and water supply are controlled to generate an optimum amount of steam for foods, and abnormalities such as heating without water are prevented from occurring beforehand to improve safety.

According to first aspect of the invention, a high frequency heating apparatus with steam generation function comprises: a high frequency generating part for supplying a high frequency wave to a heating chamber for accommodating an object to be heated; a steam generating part for generating steam inside the heating chamber; a temperature detecting part for detecting temperature of the steam generating part; and a heater control unit for controlling heating by an evaporating dish heater in the steam generating part, wherein at least any one of high frequency and steam is supplied into the heating chamber to heat-treat the object to be heated, the high frequency heating apparatus including wherein the evaporating dish heater is controlled to heat based on temperature information of the temperature detecting part for detecting temperature of the steam generating part.

The high frequency heating apparatus with steam generation function has the unit for controlling the evaporating dish heater for heating the evaporating dish, and water is supplied from the water supply part to the evaporating dish based on temperature information of the temperature detecting part disposed near the evaporating dish. Provided that new water is not supplied, the operation of the evaporating dish heater is stopped, and the evaporating dish is prevented from being heated without water. In cooking, the evaporating dish heater is controlled to adjust an amount of steam generated, and cooking can be performed at the optimum amount of steam for foods.

According to second aspect of the invention, the heater control unit controls heating even after cooking is finished in order to evaporate water left in the evaporating dish.

In the high frequency heating apparatus with steam generation function, it is likely that old, remaining water is to be used in the next cooking when water is left in the evaporating dish after cooking is finished, and it is also likely that water itself goes bad when it is left for a long time. The evaporating dish heater is controlled to prevent water from remaining in the evaporating dish even after cooking is finished, and thus the environment inside the heating chamber can be kept hygienically all the time.

According to third aspect of invention, the heater control unit controls the evaporating dish heater to carry current continuously in the beginning of cooking, and controls the evaporating dish heater to carry current intermittently in the latter half of cooking.

In the high frequency heating apparatus with steam generation function, the evaporating dish heater is controlled to carry current continuously in the beginning of cooking, and thus even cold water can generate steam for a short time. In addition, since the heater for generating steam accumulates a quantity of heat in itself after it is heated for a predetermined time, steam can be generated by the remaining heat even though there is a non-conducting period for a short time. In the latter half of cooking, the evaporating dish heater is operated intermittently to prolong the lifetime because the cumulative conducting period is shortened. The reliability of endurance of the evaporating dish heater can be improved without reducing an amount of steam generated.

According to fourth aspect of the invention, the high frequency heating apparatus comprises: a high frequency generating part for supplying a high frequency wave to a heating chamber for accommodating an object to be heated; a steam generating part for generating steam inside the heating chamber; a temperature detecting part for detecting temperature of the steam generating part; a water supply part for supplying water to the steam generating part; and a feed water control unit for controlling water supply to the water supply part, wherein at least any one of high frequency and steam is supplied into the heating chamber to heat-treat the object to be heated, the high frequency heating apparatus including wherein water supply of the water supply part is controlled based on temperature information of the temperature detecting part for detecting temperature of the steam generating part.

In the high frequency heating apparatus with steam generation function, an amount of feed water is controlled by the water pump of the water supply part based on temperature information of the temperature detecting part for detecting temperatures of the steam generating part, and an optimum amount of steam can be generated and controlled in accordance with foods. The steam generating part is prevented from being heated without water due to a shortage of water supply, water is prevented from overflowing from the steam generating part because of excessive water supply, and thus safety can be improved.

According to fifth aspect of the invention, the feed water control unit controls a water pump for supplying water to the steam generating part to carry current intermittently.

In the high frequency heating apparatus with steam generation function, the evaporating dish of the steam generating part is heated by the evaporating dish heater to generate steam. When a large amount of water is supplied from water supply part at one time, it takes time to increase the temperature of water, it takes time to generate steam, and then the entire time for cooking is prolonged. However, when a small amount of water is supplied continuously, water is not supplied throughout the evaporating dish, and it is likely to cause the dish to be partially heated without water. The water pump is operated intermittently to supply a predetermined amount of water into the evaporating dish for a short time, and a time for generating steam is shortened. The evaporating dish can be prevented from being partially heated without water due to a shortage of water supply.

According to sixth aspect of the invention, the feed water control unit stops a water pump for supplying water to the steam generating part before cooking is finished.

In the high frequency heating apparatus with steam generation function, since steam is generated from the steam generating part inside the heating chamber, water is left in the evaporating dish of the steam generating part after cooking is finished when water is supplied until cooking is finished. When the water is left as it is until next cooking, the old, remaining water is to be used in the next cooking, and it is also likely that water itself goes bad when it is left for a long time. Water supply is stopped before cooking is finished based on temperatures of the temperature detecting part of the evaporating dish, which can prevent water from remaining in the evaporating dish after cooking is finished and the inside of the apparatus can be kept hygienically.

According to seventh aspect of the invention, the high frequency heating apparatus is comprises: a high frequency generating part for supplying a high frequency wave to a heating chamber for accommodating an object to be heated; a steam generating part for generating steam inside the heating chamber; a temperature detecting part for detecting temperature of the steam generating part; a water supply part for supplying water to the steam generating part; and a display part for displaying information about the water supply part, wherein at least any one of high frequency and steam is supplied into the heating chamber to heat-treat the object to be heated, the high frequency heating apparatus including wherein water information of the water supply part is displayed on the display part based on temperature information of the temperature detecting part for detecting temperature of the steam generating part.

In the high frequency heating apparatus with steam generation function, the temperature detecting part for detecting temperature of the steam generating part can detect whether water is supplied into the steam generating part from the water supply part. Therefore, provided a risk occurs that water is not supplied from the water supply part and the evaporating dish of the steam generating part is heated without water, water being not supplied is displayed on the display part beforehand, the water storage tank of the water supply part is instructed to supply water, and thus the abnormal operation of heating without water can be prevented.

DETAILED DESCRIPTION OF THE PREFERRED EMBODIMENTS

Hereafter, a preferred embodiment of the high frequency heating apparatus with steam generation function according to the invention will be described in detail with reference to the drawings.

Figure 1:
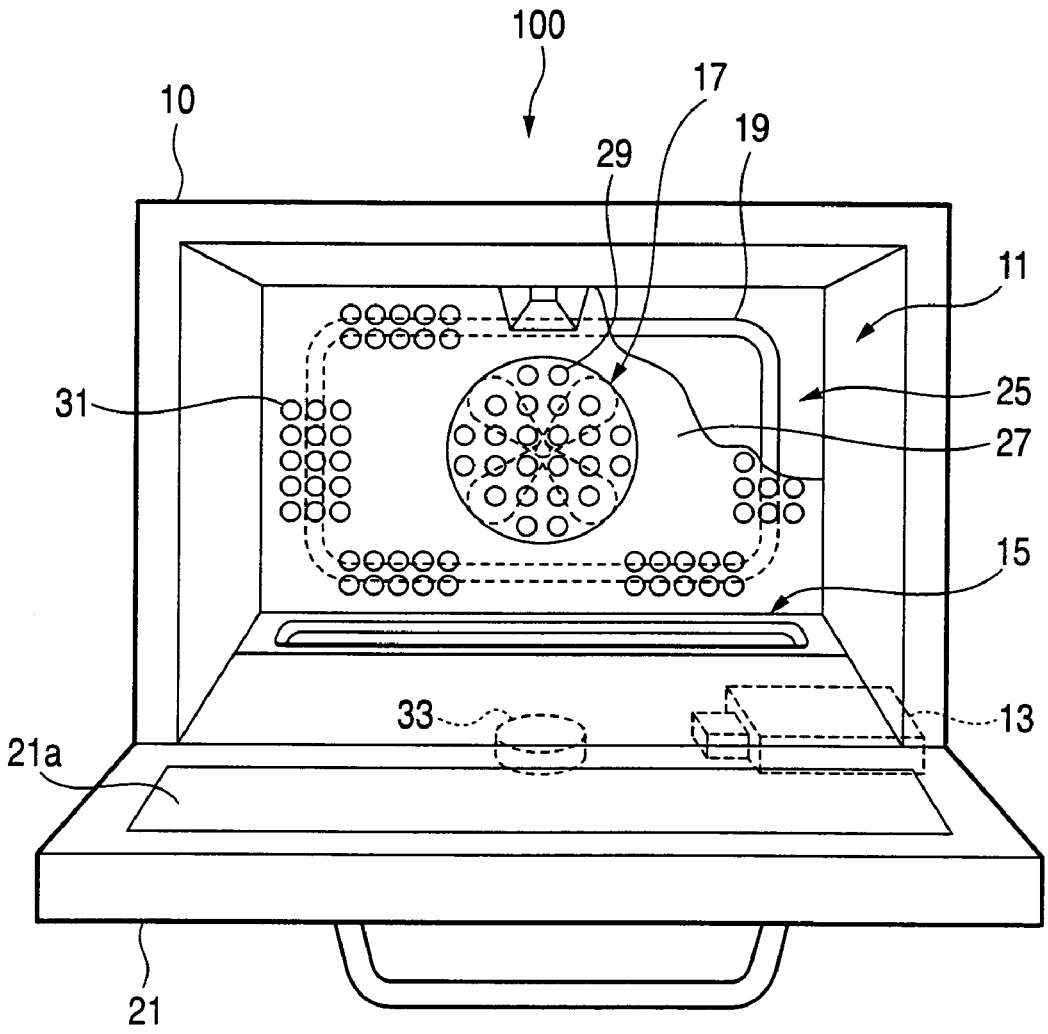
FIG. 1 is a front view illustrating a high frequency heating apparatus with steam generation function in an embodiment according to the invention, in which its door is opened.
Figure 2:
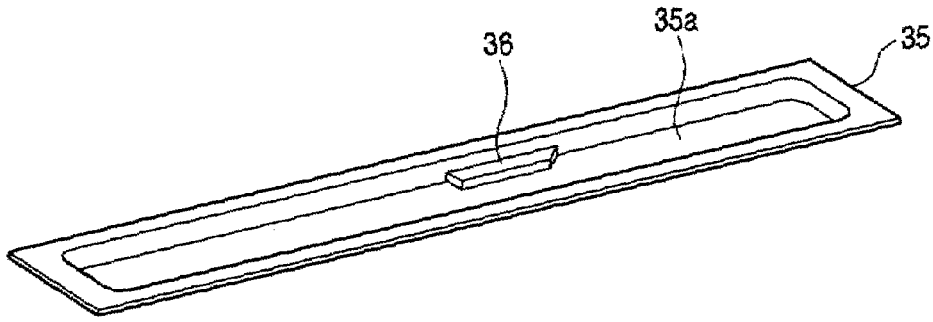
FIG. 2 is a perspective view illustrating an evaporating dish of a steam generating part used in the high frequency heating apparatus with steam generation function shown in FIG. 1.
Figure 3:
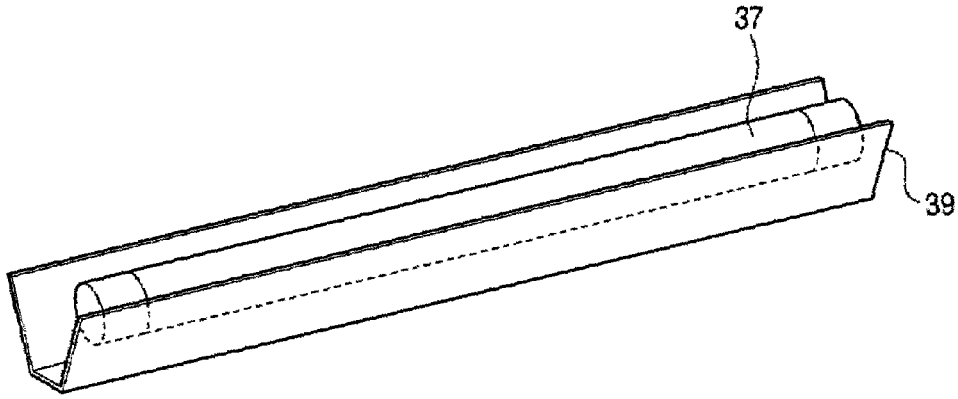
FIG. 3 is a perspective view illustrating an evaporating dish heater and a reflector of the steam generating part.
Figure 4:
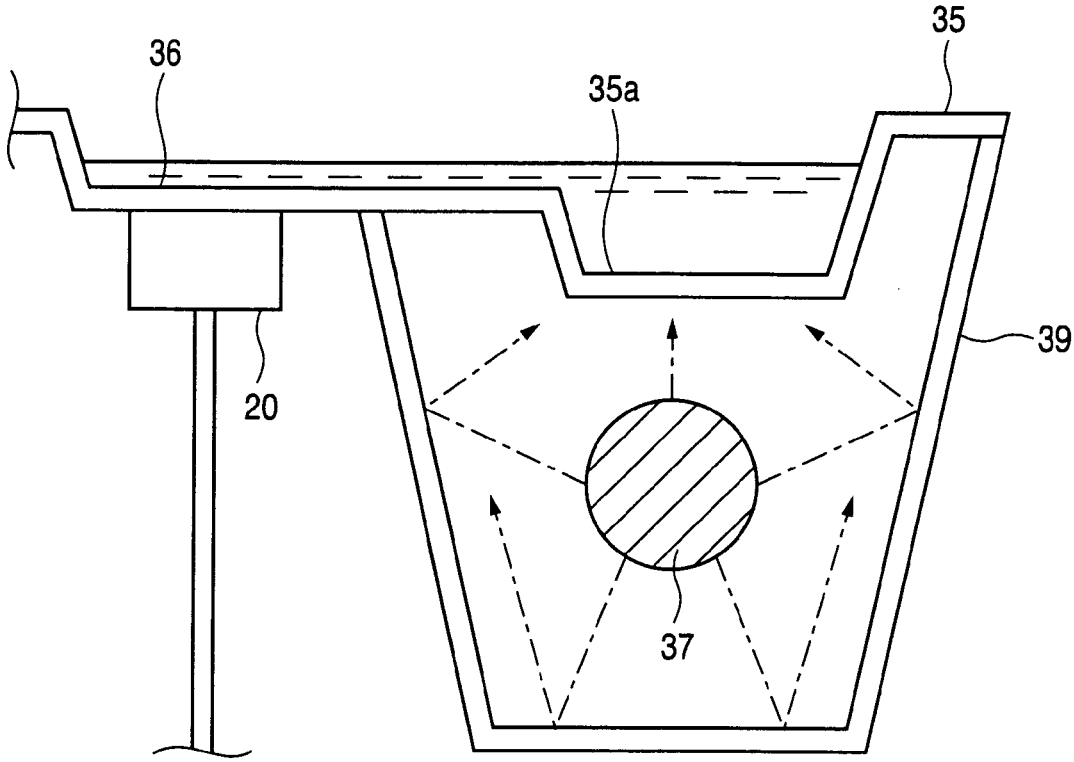
FIG. 4 is a cross-sectional view of the steam generating part in the same apparatus.

FIG. 1 is a front view illustrating a high frequency heating apparatus with steam generation function, in which its door is opened. FIG. 2 is a perspective view illustrating an evaporating dish of a steam generating part used in the apparatus, FIG. 3 is a perspective view illustrating an evaporating dish heater and a reflector of the steam generating part, and FIG. 4 is a cross-sectional view of the steam generating part.

This high frequency heating apparatus with steam generation function 100 is a cooking appliance in which at least any one of a high frequency (microwave) and steam is supplied to a heating chamber 11 for accommodating an object to be heated and the object to be heated is heat-treated. The apparatus has a magnetron 13 as a high frequency generating part for generating a high frequency wave, a steam generating part 15 for generating steam inside the heating chamber 11, a circulation fan 17 for stirring and circulating air inside the heating chamber 11, and a convection heater 19 as a heater for heating inside air.

The heating chamber 11 is formed inside a box-shaped main case 10, and a door 21 with a translucent window 21*a* for opening and closing a drawing port for the object to be heated inside the heating chamber 11 is disposed in front of the main case 10. The door 21 is openable and closable in the vertical direction by being joined to the lower rim of the main case 10 by hinge. A predetermined heat insulation space is kept between the walls of the heating chamber 11 and the main case 10, and a heat insulator is filled in the space as required. Particularly, a space behind the heating chamber 11 is a circulation fan chamber 25 for housing the circulation fan 17 and its drive motor 23 (see FIG. 9) therein, and a rear wall of the heating chamber 11 is a partition plate 27 for defining the heating chamber 11 from the circulation fan chamber 25. The partition plate 27 is disposed with air intake vent holes 29 for taking in air from the heating chamber 11 side to the circulation fan chamber 25 side, and air blowing vent holes 31 for blowing air from the circulation fan chamber 25 side to the heating chamber 11 as the forming areas are separated. Each of the vent holes 29 and 31 is formed as a plurality of punched holes.

The circulation fan 17 is disposed as the rotation canter is placed at the center part of the rectangular partition plate 27, and the rectangular ring-shaped convection heater 19 is disposed in the circulation fan chamber 25 as it surrounds the circulation fan 17. Then, the air intake vent holes 29 formed in the partition plate 27 are arranged in front of the circulation fan 17, and the air blowing vent holes 31 are arranged along the convection heater 19.

When the circulation fan 17 is rotated, winds are set to blow from the front side of the circulation fan 17 to the rear side where the drive motor is disposed. Thus, air inside the heating chamber 11 is taken in the center part of the circulation fan 17 through the air intake vent holes 29, and it is sent from the air blowing vent holes 31 into the heating chamber 11 through the convection heater 19 inside the circulation fan chamber 25. Therefore, the air inside the heating chamber 11 is circulated by this flow through the circulation fan chamber 25 as the air is stirred.

The magnetron 13 is disposed in the space under the heating chamber 11, for example, and a stirrer 33 is disposed at the position receiving a high frequency generated from the magnetron. Then, the high frequency wave from the magnetron 13 is irradiated onto the stirrer 33 rotating to supply the high frequency waves into the heating chamber 11 by the stirrer 33 as the high frequency is stirred. In addition, the magnetron 13 and the stirrer 33 can be disposed not only on the bottom of the heating chamber 11 but also on the top or side of the heating chamber 11.

The steam generating part 15 is configured of an evaporating dish 35 having a recess 35*a* for containing water to generate steam by heating and a projecting surface 36 as shown in FIG. 2, an evaporating dish heater 37 disposed under the evaporating dish 35 for heating the evaporating dish 35 as shown in FIGS. 3 and 4, and a reflector 39 having a nearly U-shape in cross section for reflecting radiant heat from the heater toward the evaporating dish 35. A temperature detecting part 20 is disposed under the evaporating dish 35 and outside the reflector 39. The evaporating dish 35 is a long slender plate made of metal, which is disposed so that its longitudinal side is oriented along the partition plate 27 for defining the heating chamber 11 from the circulation fan chamber 25 in the rear bottom surface on the opposite side of the drawing port for the object to be heated inside the heating chamber 11. Furthermore, as the evaporating dish heater 37, a glass tube heater, a sheathed heater, and a plate-heater are usable.

Figure 5:
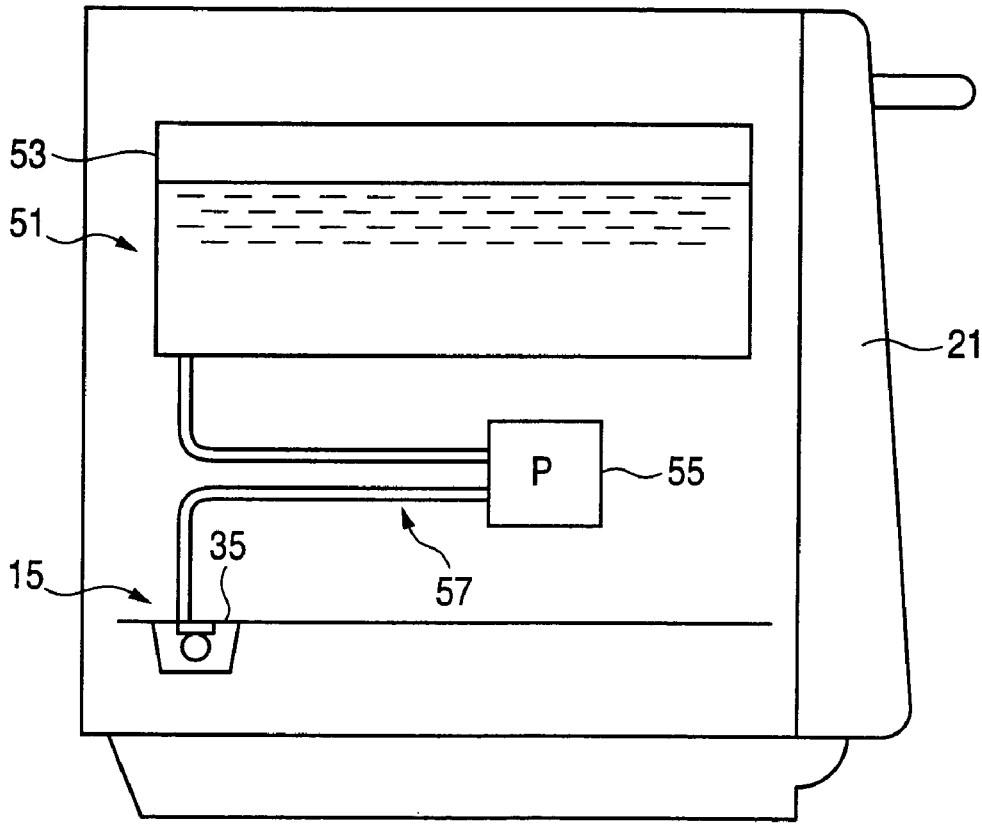
FIG. 5 is a side view illustrating an essential part of the high frequency heating apparatus with steam generation function according to the invention.
Figure 6:
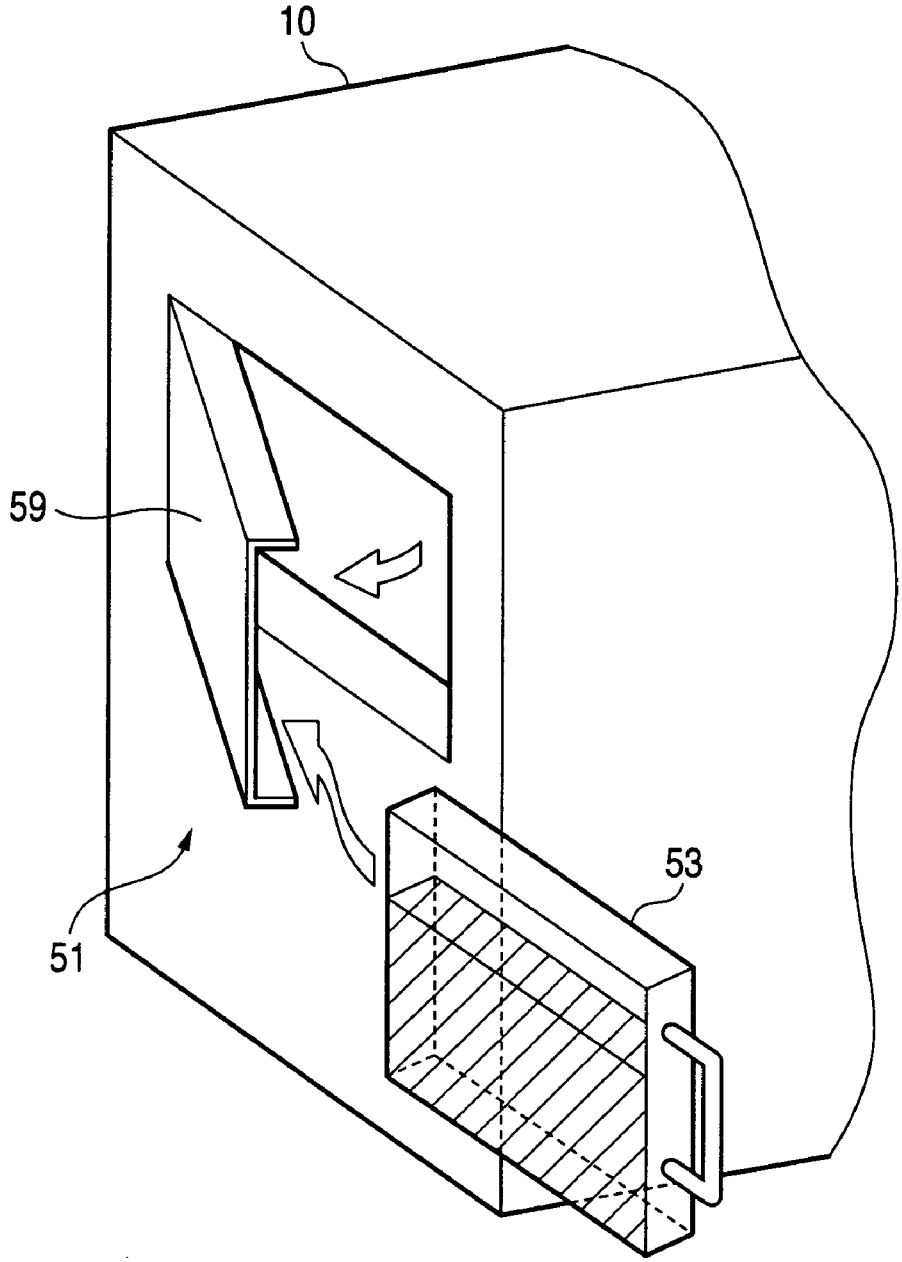
FIG. 6 is an explanatory diagram illustrating a detachable water storage tank.

Moreover, as shown in FIGS. 5 and 6, a water supply part 51 has a water storage tank 53, a water pump 55 for supplying a predetermined amount of water into the evaporating dish 35 from the water storage tank 53, and pipes 57 for connecting the water storage tank 53 to the evaporating dish 35.

According to the configuration, since water can be supplied to the evaporating dish 35 continuously, continuous steam heating can be performed for a long time. Furthermore, as shown in FIG. 6 of a partially perspective view illustrating the side of the apparatus, the water storage tank 53 is formed in a cartridge type, which is compactly embedded in a side wall part at relatively low temperature in the main case 10 so as not to increase the apparatus itself in size when assembled in the apparatus. In addition to this, it is fine to dispose the tank on the top of the apparatus with insulation, or on the underside. Preferably, the cartridge type water storage tank 53 can be detached from outside the apparatus and easily changed. Thus, ease of handling can be enhanced, and the tank is easy to clean. For example, as shown in the drawing, it is acceptable that the tank can be loaded and unloaded from the side of the apparatus by opening and closing a cover 59, or from the front of the apparatus. Furthermore, the cartridge type water storage tank 53 is preferably configured to visually confirm an amount of water left in the water storage tank 53 from outside in which the tank is formed of a transparent material such as resin or glass and the wall of the main case where the tank is housed is also formed of a transparent material.

Figure 7:
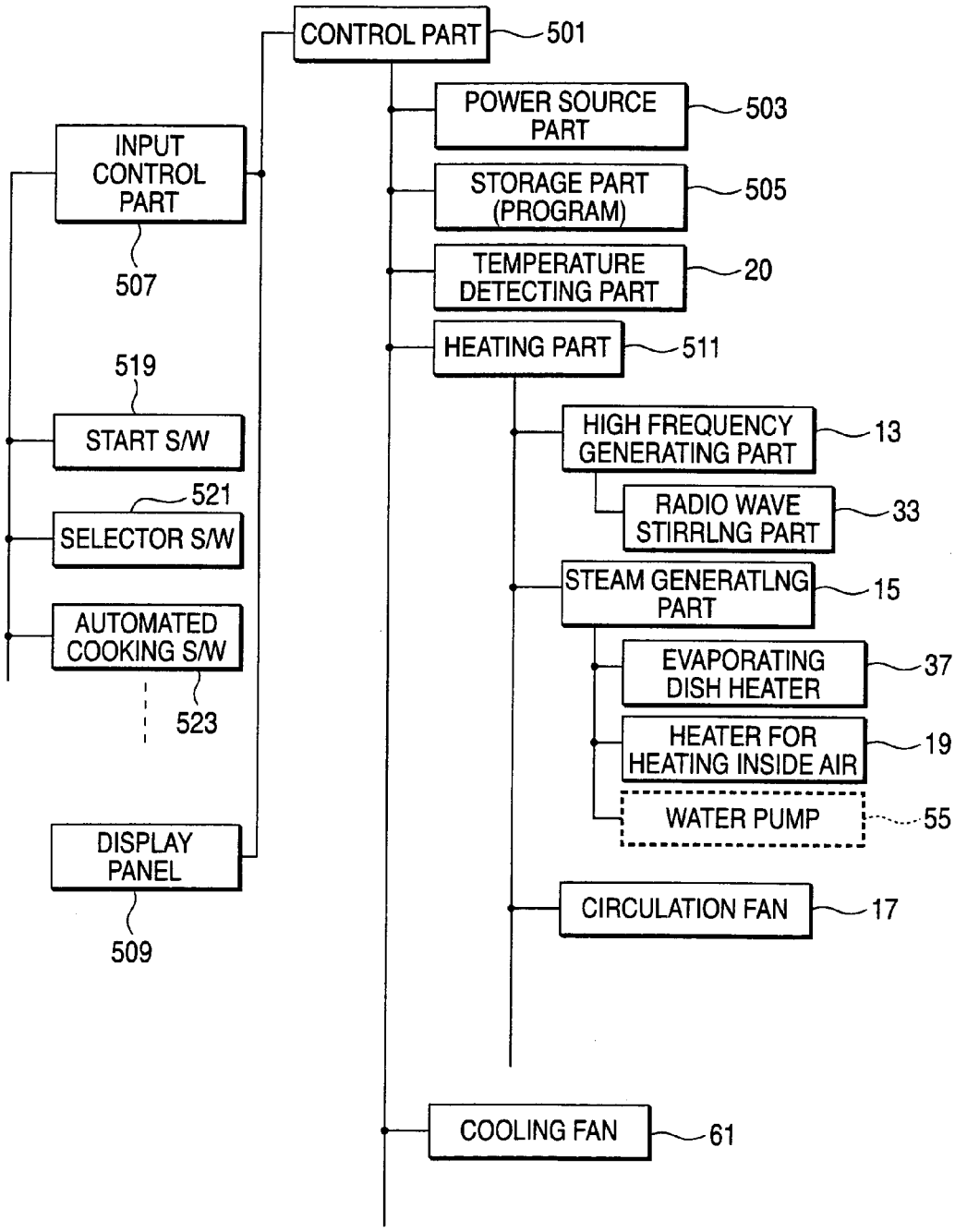
FIG. 7 is a block diagram of a control system for controlling the high frequency heating apparatus with steam generation function.

FIG. 7 is a block diagram of a control system for controlling the high frequency heating apparatus with steam generation function 100. The control system is mainly configured of a control part 501 with a microprocessor, for example. The control part 501 sends and receives signals mainly between a power supply part 503, a storage part 505, an input control part 507, a display panel 509, the temperature detecting part 20, a heating part 511, and a cooling fan 61.

To the input control part 507, various operating switches are connected, including a start switch 519 for instructing heating to start, a selector switch 521 for switching heating methods such as high frequency heating and steam heating, and an automated cooking switch 523 for starting programs prepared beforehand.

To the heating part 511, the high frequency generating part 13, the steam generating part 15, and the circulation fan 17 are connected. In addition, the high frequency generating part 13 operates in cooperation with the radio wave stirring part (the drive part of the stirrer) 33. To the steam generating part 15, the evaporating dish heater 37, and the heater 19 for heating inside air (convection heater) are connected.

Figure 8:
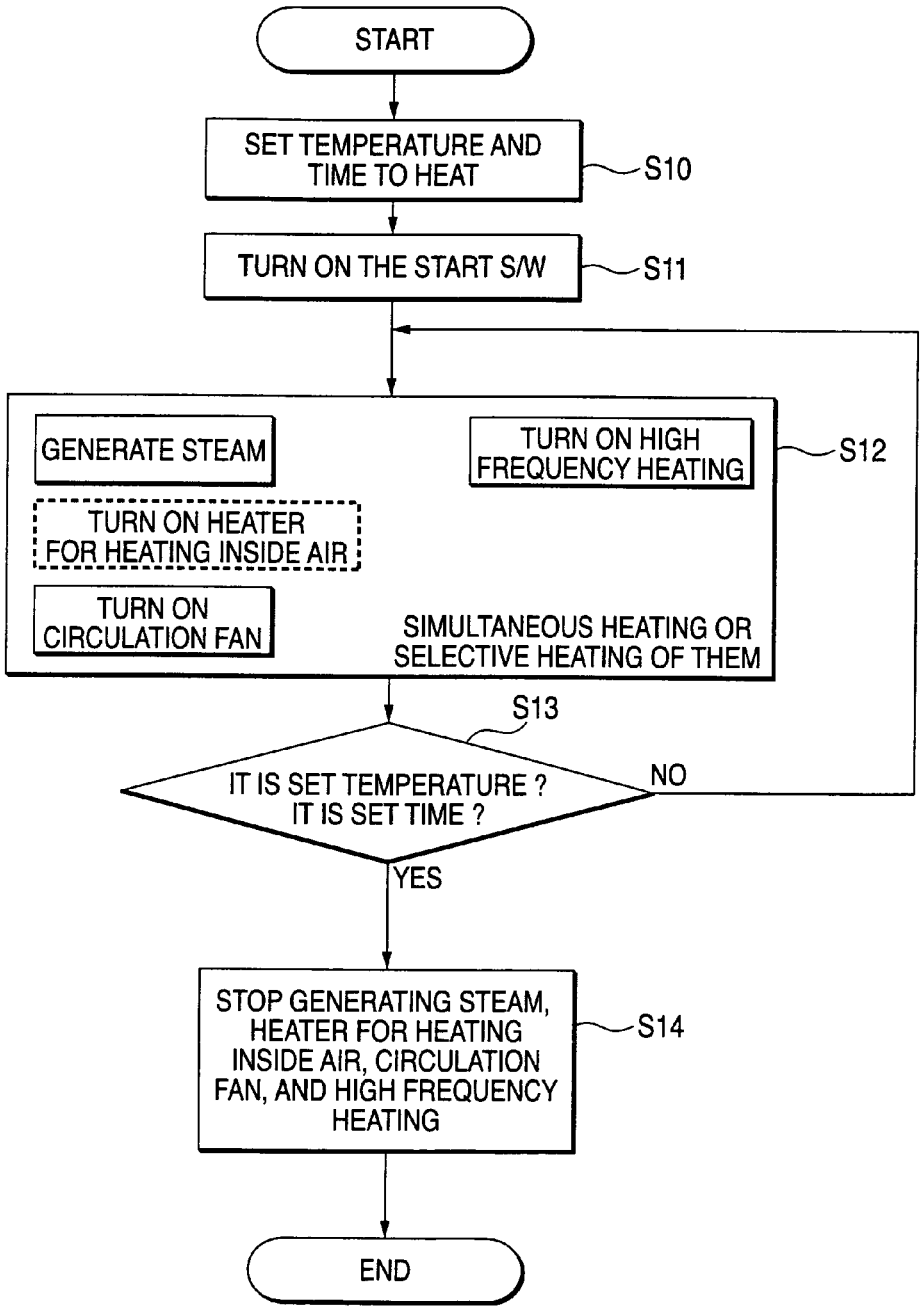
FIG. 8 is a flow chart illustrating a basic operation of the high frequency heating apparatus with steam generation function.

Next, the basic operation of the high frequency heating apparatus with steam generation function 100 will be described with reference to a flow chart shown in FIG. 8.

As the procedures of the operation, food to be heated is first put on a plate and put in the heating chamber 11, and then the door 21 is closed. Subsequently, a heating method, temperature or time to heat is set by the input control part 507 (Step 10, hereafter, it is abbreviated by S10), and the start switch is turned ON (S11). Then, the control part 501 operates to perform heat treatment automatically (S12).

More specifically, the control part 501 reads the set temperature and time to heat, selects and executes the best cooking method based on those, and determines whether to reach the set temperature and time to heat (S13). When set values are reached, the control part stops each of the heating sources to end heat treatment (S14). Additionally, in S12, to generate steam, to turn on the heater for heating inside air, to rotate the circulation fan, and to do high frequency heating are performed separately or simultaneously.

Figure 9:
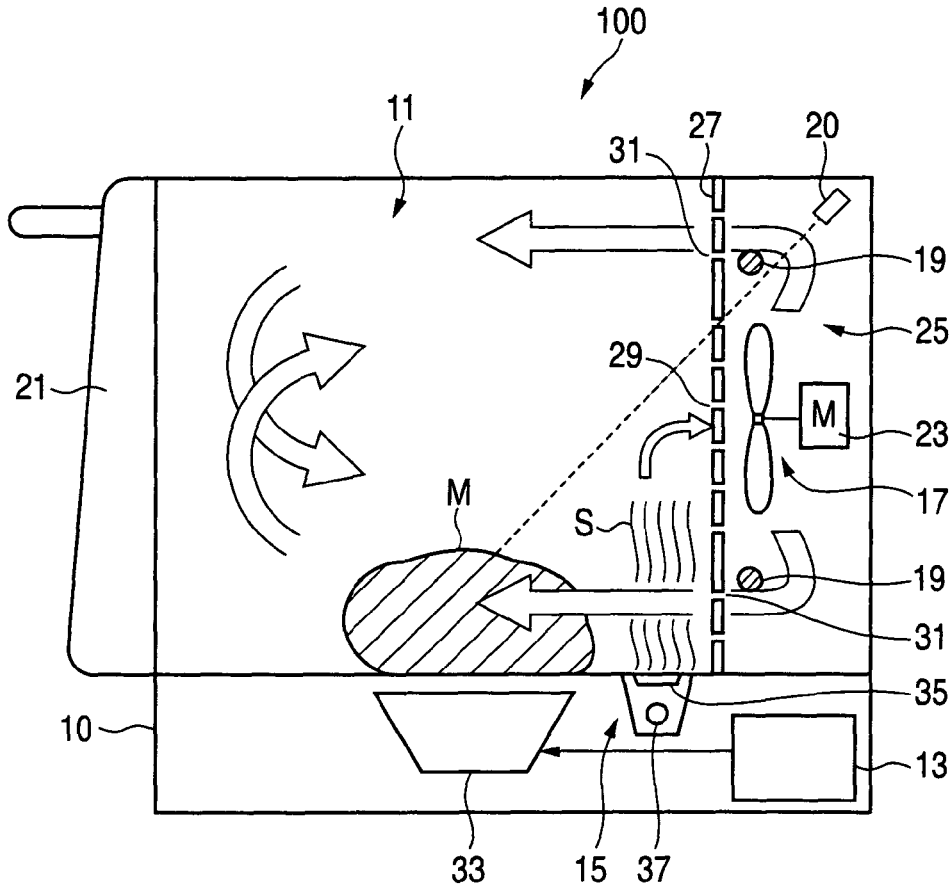
FIG. 9 is an explanatory diagram illustrating the operation of the high frequency heating apparatus with steam generation function.

In the operation described above, the effect in the case where a mode to generate steam and to turn on the circulation fan, for example, is selected and executed will be described. When this mode is selected, the evaporating dish heater 37 is turned on, and then water in the evaporating dish 35 is heated to generate steam S, as shown in FIG. 9 of an explanatory diagram of the operation of the high frequency heating apparatus 100. The steam S rising from the evaporating dish 35 is aspirated into the center part of the circulation fan 17 from the air intake vent holes 29 arranged nearly in the center part of the partition plate 27, and is blown into the heating chamber 11 from the air blowing vent holes 31 arranged in the periphery of the partition plate 27. The blown steam is stirred in the heating chamber 11, and again aspirated into the circulation fan chamber 25 from the air intake vent holes 29 nearly in the center part of the partition plate 27. Therefore, a circulation path is formed in the heating chamber 11 and the circulation fan chamber 25. Furthermore, the generated steam is guided to the air intake vent holes 29 without arranging the air blowing vent holes 31 below the position of the circulation fan 17 of the partition plate 27. Then, as depicted by outline arrows in the drawing, the steam is circulated in the heating chamber 11, and the steam is blown onto an object to be heated M.

Next, the control method of the high frequency heating apparatus with steam generation function having the configuration described above will be described in detail.

Figure 10:
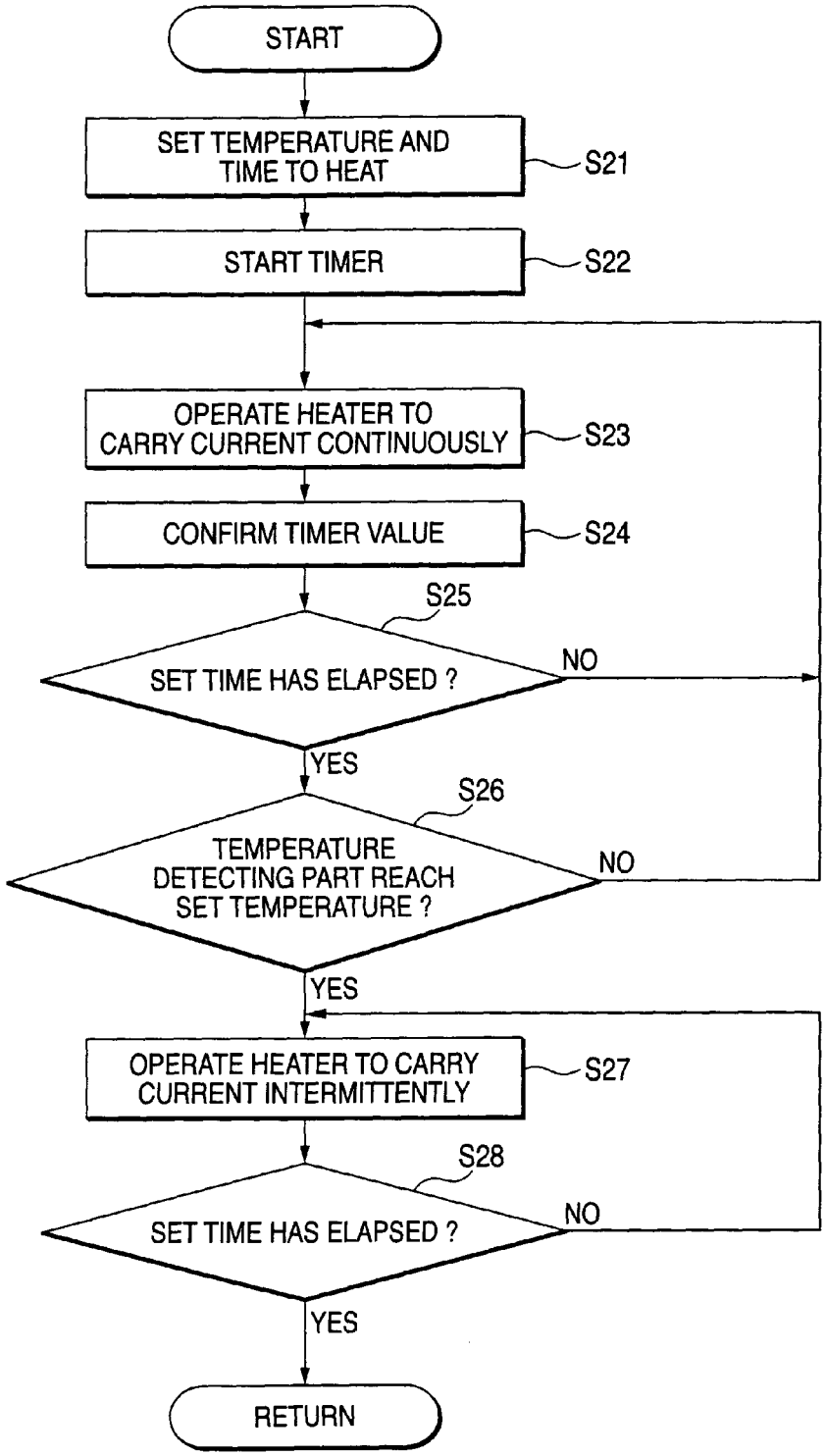
FIG. 10 is a flowchart illustrating basic procedures when an evaporating dish heater is controlled in accordance with temperatures of an evaporating dish.

FIG. 10 is a flow chart illustrating basic procedures when the evaporating dish heater 37 is controlled in accordance with temperatures of the evaporating dish 35. In this flow, the set value of time to heat is first read (S21), a timer is started to begin heating by the evaporating dish heater 37 to carry current continuously (S22 and S23). In heating, the value of the timer is monitored, and then it is confirmed whether the temperature of the temperature detecting part 20 reaches a preset temperature after the set time has elapsed (S24, S25 and S26). When the preset temperature is reached, the evaporating dish heater 37 is switched to carry current intermittently (S27) and heating is stopped when the set time has elapsed (S28).

Next, the operation patterns of the evaporating dish heater 37 and the water pump 55 of the water supply part 51 will be described.

Figure 11:
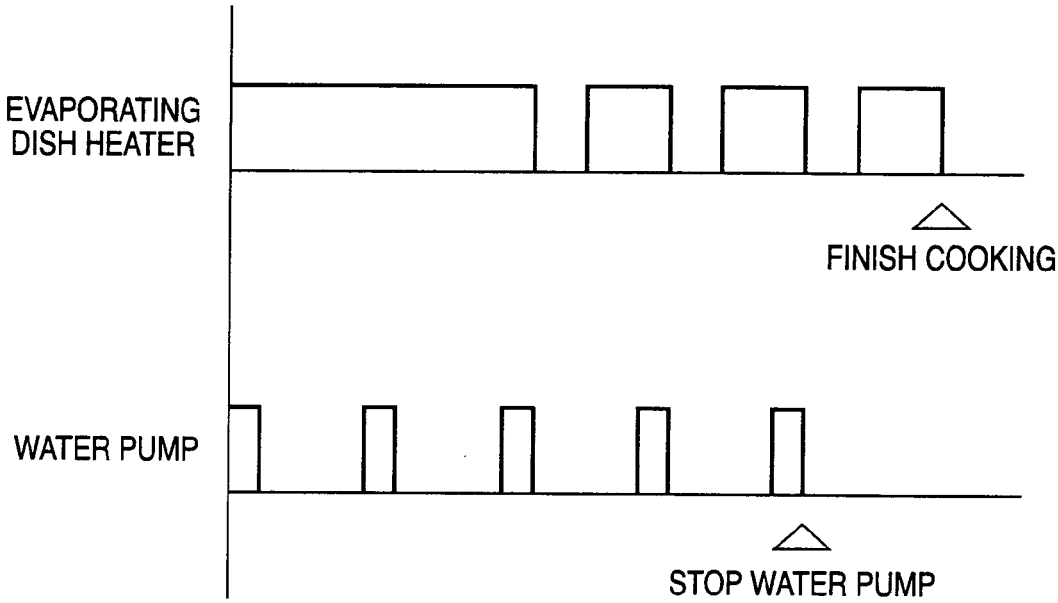
FIG. 11 is a timing chart of the operations of the evaporating dish heater and a water pump for supplying water into the evaporating dish.

FIG. 11 is a timing chart of the operations of the evaporating dish heater 37 and the water pump 55 for supplying water into the evaporating dish 35. The evaporating dish heater 37 is operated to carry current continuously for a first predetermined time in cooking, and to carry current intermittently to heat the evaporating dish 35 after the predetermined time has elapsed. The water pump 55 is operated to carry current intermittently to supply a predetermined amount of water into the evaporating dish 35. After operated for a predetermined time, the water pump 55 stops its operation before cooking is finished, and the evaporating dish heater 37 heats the water left in the evaporating dish 35 until cooking is finished.

Figure 12:
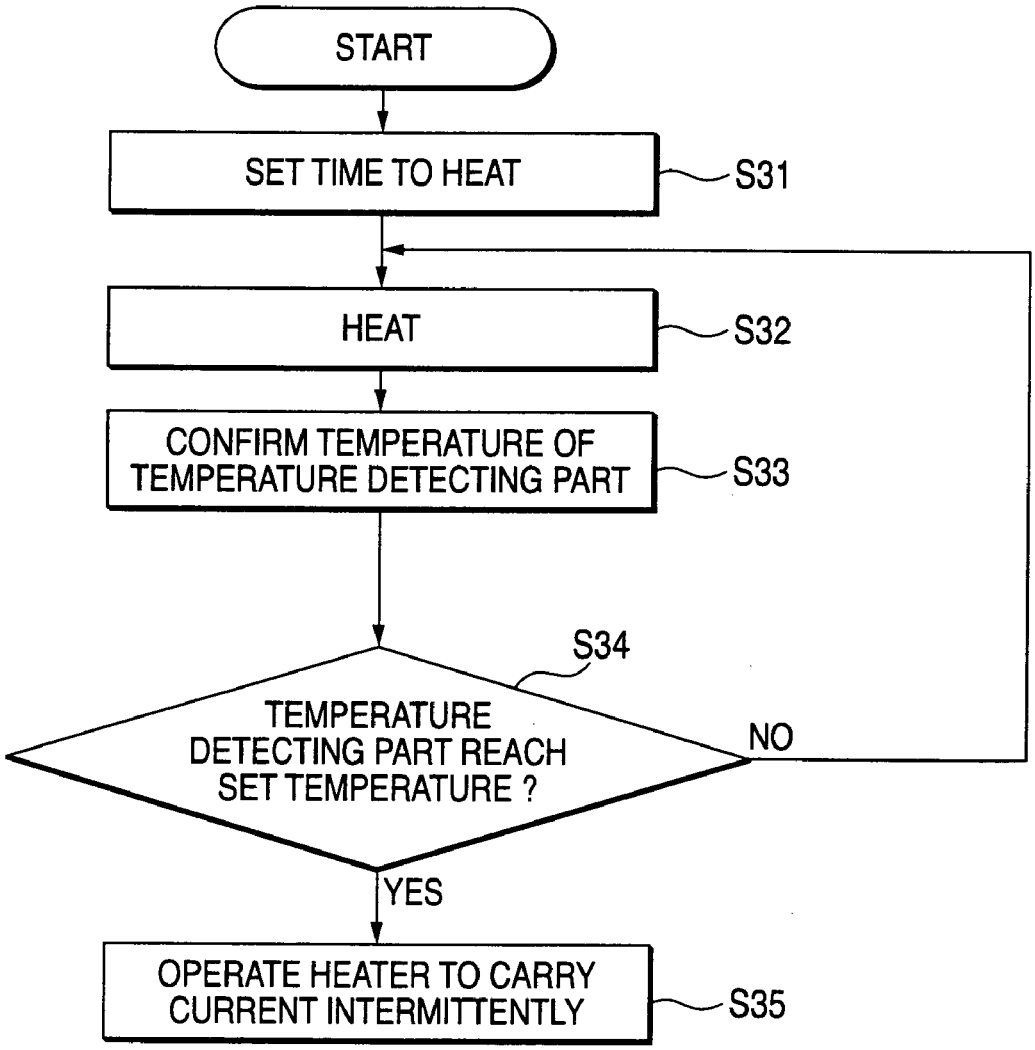
FIG. 12 is a flow chart illustrating basic procedures of showing display on a display panel in accordance with temperatures of the evaporating dish.

FIG. 12 is a flow chart illustrating basic procedures of showing display on the display part (display panel) 509 in accordance with temperatures of the evaporating dish 35. In this flow, the set value of heating time is first read (S31), and start heating (S32). In heating, the temperatures of the temperature detecting part 20 are monitored all the time to confirm whether an amount of water left in the evaporating dish 35 is proper. Then, when the temperature that is determined as water is not supplied to the evaporating dish 35 is detected, display is shown on the display panel 509 that water is not supplied (S35).

As described above, according to the high frequency heating apparatus with steam generation function, since it is configured to generate steam inside the heating chamber 11, not outside, the portion of generating steam, that is, the evaporating dish 35 can be cleaned easily as similar to the case of cleaning the inside of the heating chamber 11. For example, calcium, magnesium, and chlorine compounds in water are sometimes concentrated to precipitate and fix onto the bottom of the evaporating dish 35 in the course of generating steam, but those fixed onto the surface of the evaporating dish 35 can be removed cleanly only by wiping them with cloth. In addition, since the water pump for supplying water into the evaporating dish 35 is stopped before cooking is finished, water is not left after cooking. Furthermore, provided that water is left after cooking, a period of carrying current through the evaporating dish heater is extended to evaporate the water left in the evaporating dish, which facilitates keeping the inside of the heating chamber 11 in a hygienic environment all the time with easy wiping.

Moreover, in the high frequency heating apparatus, since the evaporating dish 35 is heated by the evaporating dish heater 37 to generate steam, the steam can be supplied efficiently with a simple structure. In addition, since steam at high temperature to some extent is generated by heating, cooking simply steamed or cooking in combination with high frequency heating so as not to be dried is possible.

Furthermore, an amount of feed water can be controlled by the water pump of the water supply part based on temperature information of the temperature detecting part, and an optimum amount of steam can be generated and controlled in accordance with foods. The steam generating part is prevented from being heated without water due to a shortage of water supply, water is prevented from overflowing from the steam generating part because of excessive water supply, and safety can be improved.

Moreover, even cold water can generate steam for a short time by controlling the evaporating dish heater to carry current continuously in the beginning of cooking. The lifetime can be prolonged by intermittently operating the evaporating dish heater in the latter half of cooking because the cumulative conducting period of the heater is shortened. The reliability of endurance of the evaporating dish heater can be improved without reducing an amount of steam generated.

In addition, the temperature detecting part can detect whether water is supplied to the steam generating part from the water supply part. Therefore, provided a risk occurs that water is not supplied from the water supply part and the evaporating dish of the steam generating part is heated without water, water being not supplied is displayed on the display part beforehand, the water storage tank of the water supply part is instructed to supply water, and thus the abnormal operation of heating without water can be prevented.

Moreover, as the heating methods, both of high frequency heating and steam heating can be performed at the same time, either high frequency heating or steam heating can be performed separately, and both can be performed in a predetermined order freely. Thus, a suitable cooking method can be selected freely in accordance with types of foods, frozen foods and refrigerated foods. Particularly, since a rate of temperature rise in the object to be heated can be accelerated when high frequency heating and steam heating are used in combination, efficient cooking is feasible.

As described above, according to the first to seventh aspects of the invention, the steam can be supplied into the heating chamber quickly, and the efficiency of generating steam can be improved. Additionally, the steam generating part can be cleaned, and the inside of the heating chamber can be kept in a hygienic environment all the time. Furthermore, temperatures of the steam generating part and water supply are controlled to generate an optimum amount of steam for foods, abnormalities such as heating without water are prevented from occurring beforehand, and safety can be improved.

What is claimed is:

1. A high frequency heating apparatus comprising:

a high frequency generating part for supplying a high frequency wave to a heating chamber for accommodating an object to be heated;

a steam generating part, located only in a recessed portion in the rear bottom of the heating chamber, for generating steam inside the heating chamber;

a temperature detecting part for detecting temperature of the steam generating part; and a heater control unit for controlling heating by an evaporating dish heater in the steam generating part, wherein at least any one of high frequency wave and steam is supplied into the heating chamber to heat-treat the object to be heated, the high frequency heating apparatus including wherein the evaporating dish heater is controlled to heat based on temperature information of the temperature detecting part for detecting temperature of the steam generating part, wherein the temperature detecting part can further detect the absence of water in the steam generating part.

2. The high frequency heating apparatus according to claim 1, wherein the heater control unit controls heating even after cooking is finished in order to evaporate water left in the evaporating dish.

3. The high frequency heating apparatus according to claim 1, wherein the heater control unit controls the evaporating dish heater to carry current continuously in a beginning of cooking, and controls the evaporating dish heater to carry current intermittently in a latter half of cooking.

4. A high frequency heating apparatus comprising:

a high frequency generating part for supplying a high frequency wave to a heating chamber for accommodating an object to be heated;

a steam generating part, located only in a recessed portion in the rear bottom of the heating chamber, for generating steam inside the heating chamber;

a temperature detecting part for detecting temperature of the steam generating part;

a water supply part for supplying water to the steam generating part; and a feed water control unit for controlling water supply to the water supply part, wherein at least any one of high frequency wave and steam is supplied into the heating chamber to heat-treat the object to be heated, the high frequency heating apparatus including wherein water supply of the water supply part is controlled based on temperature information of the temperature detecting part for detecting temperature of the steam generating part, wherein the temperature detecting part can further detect the absence of water in the steam generating part.

5. The high frequency heating apparatus according to claim 4, wherein the feed water control unit controls a water pump for supplying water to the steam generating part to carry current intermittently.

6. The high frequency heating apparatus according to claim 4, wherein the feed water control unit stops a water pump for supplying water to the steam generating part before cooking is finished.

7. A high frequency heating apparatus comprising:

a high frequency generating part for supplying a high frequency wave to a heating chamber for accommodating an object to be heated;

a steam generating part, located only in a recessed portion in the rear bottom of the heating chamber, for generating steam inside the heating chamber;

a temperature detecting part for detecting temperature of the steam generating part;

a water supply part for supplying water to the steam generating part; and a display part for displaying information about the water supply part, wherein at least any one of high frequency wave and steam is supplied into the heating chamber to heat-treat the object to be heated, the high frequency heating apparatus including wherein water information of the water supply part is displayed on the display part based on temperature information of the temperature detecting part for detecting temperature of the steam generating part, wherein the temperature detecting part can further detect the absence of water in the steam generating part.

8. A cooking apparatus comprising:

a high frequency generating part for supplying a high frequency wave to a heating chamber for a first cooking mode;

a steam generating part for a second cooking mode, the steam generating part including:

an evaporating dish, located only in a recessed portion in the rear bottom of the heating chamber; and, a heater for heating the evaporating dish to generate steam inside the heating chamber;

a heater control unit to control the heater;

a temperature detecting part for detecting the temperature of the steam generating part; and a switch to select between the first cooking mode and the second cooking mode, wherein the temperature detecting part can further detect the absence of water in the steam generating part.

9. The cooking apparatus of claim 8 wherein the switch is further selectable to a third cooking mode where the third cooking mode includes operation of both the first and second cooking modes.

10. The cooking apparatus of claim 9 wherein operation of the first and second cooking modes in the third cooking mode is simultaneous.

11. A cooking apparatus comprising:

a high frequency generating part for supplying a high frequency wave to a heating chamber for a first cooking mode;

a steam generating part for a second cooking mode, the steam generating part including:

an evaporating dish, located only in a recessed portion in the rear bottom of the heating chamber; and, a heater for heating the evaporating dish to generate steam inside the heating chamber;

a temperature detecting part for detecting temperature of the steam generating part;

a heater control unit to control the heater; and a switch for selecting between the first and second cooking modes;

wherein the switch is further selectable to a third cooking mode where the third cooking mode includes operation of both the first and second cooking modes, wherein the temperature detecting part can further detect the absence of water in the steam generating part.

12. The cooking apparatus of claim 11, wherein the operation of the first and second cooking modes in the third cooking mode is simultaneous.

* * * * *